US005388044A

United States Patent [19]

Hepp

[11] Patent Number: 5,388,044

[45] Date of Patent: Feb. 7, 1995

[54] DIPMETER PROCESSING TECHNIQUE

[76] Inventor: Vincent R. Hepp, Mas Philadelphe, Qt. St-Gabriel, Acton, Mass. 01720

[21] Appl. No.: 191,127

[22] Filed: Feb. 3, 1994

[51] Int. Cl.[6] ..... G01V 1/00; G06F 15/58

[52] U.S. Cl. ..... 364/421; 73/151; 73/152; 367/25; 367/33

[58] Field of Search ..... 364/420–422; 73/151, 152; 367/25, 33

[56] References Cited

U.S. PATENT DOCUMENTS 4,303,975 12/1981 Hepp .
4,348,748 9/1982 Clavier et al. .
4,357,660 11/1982 Hepp .
4,414,656 11/1983 Hepp .
4,852,005 7/1989 Hepp et al. .
4,853,855 8/1989 Kerzner .
4,873,636 10/1989 Hepp .
4,939,649 7/1990 Duffy .
4,942,528 7/1990 Kerzner .

OTHER PUBLICATIONS

Vincent R. Hepp, "On the Integration of Dipmeter Surveys," The Log Analyst, Jul.-Aug. 1992, pp. 399–414.

E. F. Stratton & R. G. Hamilton, "Applications of Dipmeter Surveys," 1950 AIME convention and republished in L. W. Leroy, ed., Subsurface Geologic Methods, 2d ed., Colorodo School of Mines, Golden, Co.

M. R. Stauffer, "The Geometry of Conical Folds," N. Z. Journal of Geology and Geophysics, May 1964, pp. 340–347.

Gilbert Wilson, "The Geometry of Cylindrical and Conical Folds," Proc. Geol. Ass., vol. 78, Part 1, 1967, pp. 179–209.

Schlumberger, "Relationship of Dipmeter with Structural Contour Maps," Fundamentals of Dipmeter Interpretation, 1970, pp. 84–87.

C. A. Bengston, "Statistical curvature analysis methods for interpretation of dipmeter data," Oil & Gas Journal, Jun. 23, 1980, pp. 172–190.

C. A. Bengtson, "Structural uses of tangent diagrams," Geology, v. 8, 1980, pp. 399–414.

Donald M. Ragan, "Structural Geology: An Introduction to Geometrical Techniques" (3rd Ed.), John Wiley & Sons, Inc., pp. 219 and 243–244.

*Primary Examiner*—Gail O. Hayes
*Assistant Examiner*—Frantzy Poinvil
*Attorney, Agent, or Firm*—Richard C. Litman

[57] ABSTRACT

A method of dipmeter processing fits a thickness conserving mathematical model to a folded or faulted subsurface sedimentary geological structure, and may be used with vertical as well as nonvertical or deviated boreholes. An initial estimate of the geometry of the structure is made and then used to generate a theoretical dip profile for the model. The dip profile is compared to an actual dip profile recorded in a borehole drilled in the structure. The estimates are modified by an iterated process until satisfactory concordance is obtained between the theoretical dip profile and actual dip profile. The iterated result gives geometric parameters which accurately model the structure. The model is graphically displayed to represent the structure. The model allows the prediction of dip configurations along any other borehole to be drilled in the structure.

12 Claims, 3 Drawing Sheets

FIG. 2

| | |
|---|---|
| NORTH APEX | 2000 |
| EAST APEX | -650 |
| DEPTH APEX | 4000 |
| AXIS AZIMUTH | 0 |
| AXIS PLUNGE | 75 |
| CONE APERATURE | 55 |
| HYPERBOLE BASE | 500 |

WELL HEAD COORDINATES

| | |
|---|---|
| NORTH: | 555 |
| EAST: | -632 |
| SEA LEVEL: | 345 |
| CASING LENGTH: | 1580 |
| CASING SHOE DEVIATION: | 1@270 |
| NUMBER OF LEVELS: | 25 |

| MEASURED DEPTH | TVD (Z) | DIP MAGNITUDE | DIP AZIMUTH | LAMDA λ | NORTH (X) | EAST (Y) |
|---|---|---|---|---|---|---|
| Measured depth | TVD (z) | dip magnitude | dip azimuth | lambda λ | North (x) | East (y) |
| 1600.00 | 637.40 | 24.79 | 180.78 | -3001.17 | 555.40 | -632.45 |
| 1700.00 | 737.27 | 25.29 | 180.68 | -2894.46 | 559.47 | -634.58 |
| 1800.00 | 837.06 | 25.74 | 180.66 | -2787.96 | 565.85 | -634.76 |
| 1900.00 | 936.78 | 26.17 | 180.73 | -2681.45 | 573.02 | -632.94 |
| 2000.00 | 1036.44 | 26.59 | 180.87 | -2574.89 | 580.48 | -629.49 |
| 2100.00 | 1136.00 | 27.00 | 181.09 | -2468.24 | 588.02 | -624.05 |
| 2200.00 | 1235.46 | 27.42 | 181.38 | -2361.48 | 595.44 | -616.85 |
| 2300.00 | 1334.71 | 27.84 | 181.77 | -2254.68 | 602.75 | -607.14 |
| 2400.00 | 1433.63 | 28.32 | 182.29 | -2147.57 | 608.47 | -593.90 |
| 2500.00 | 1532.09 | 28.89 | 182.96 | -2039.72 | 610.49 | -576.80 |
| 2600.00 | 1629.90 | 29.60 | 183.71 | -1930.74 | 606.65 | -556.69 |
| 2700.00 | 1726.91 | 30.44 | 184.47 | -1820.30 | 595.38 | -535.52 |
| 2800.00 | 1822.76 | 31.36 | 185.14 | -1708.69 | 576.47 | -514.58 |
| 2900.00 | 1917.30 | 32.31 | 185.84 | -1596.55 | 553.33 | -491.74 |
| 3000.00 | 2010.96 | 33.27 | 186.61 | -1484.24 | 530.15 | -465.50 |
| 3100.00 | 2104.92 | 34.17 | 187.36 | -1371.28 | 508.61 | -438.95 |
| 3200.00 | 2200.01 | 34.99 | 188.07 | -1257.97 | 492.41 | -412.87 |
| 3300.00 | 2296.12 | 35.73 | 188.77 | -1144.73 | 482.02 | -387.39 |
| 3400.00 | 2393.13 | 36.40 | 189.37 | -1031.48 | 475.27 | -364.19 |
| 3500.00 | 2490.93 | 36.97 | 189.87 | - 918.37 | 471.58 | -343.76 |
| 3600.00 | 2589.40 | 37.45 | 190.26 | - 805.50 | 470.28 | -326.47 |
| 3700.00 | 2688.41 | 37.85 | 190.54 | - 692.93 | 470.68 | -312.58 |
| 3800.00 | 2787.85 | 38.14 | 190.68 | - 580.90 | 472.70 | -302.42 |
| 3900.00 | 2887.59 | 38.34 | 190.71 | - 469.26 | 475.29 | -295.95 |

DIPMETER PROCESSING TECHNIQUE

BACKGROUND OF THE INVENTION

1. FIELD OF THE INVENTION

The present invention relates to a method of precise geometric modeling of folded subsurface geological formations, and more particularly, a modeling method based on surveys of formation dip and of the variations of the dip as recorded in holes vertically or directionally bored through said formations by a dipmeter tool.

2. DESCRIPTION OF THE PRIOR ART

Accumulated sediments, which are originally laid in horizontal or sub-horizontal layers, can become folded with time and with changes of lateral and vertical stress to create folds of various sizes and shapes. The folds may create a shape that is generally conical. This conical folding may be visualized as a plurality of nested cups with an essentially horizontal plane passing through the center axis of each of the cups. Where stress exceeds certain points of rupture, faults appear and complicate the folded configuration. Such folds and faults may be shown in surface geological surveys and maps, and in rock outcrops as on the sides of scarps in mountainous regions. Geologists infer the three dimensional geometry of these structures by extrapolating data from surface geological surveys. These extrapolations are conjectural by nature and are valid only over a skin of earth's surface with a thickness on the order of a fraction of a mile.

Subsurface geophysical surveys, such as seismic surveys, permit a deeper penetration into the earth's crust and, consequentially, allow for more interpolation. However, these subsurface surveys also depend on certain assumptions such as the distribution of acoustic velocities in the volume of sediments being investigated, the amount and mode of refraction through these sediments, and the need to "migrate" reflection points where formation dip becomes important. Seismic waves are bent by reflectors which are rocks or sedimentary layers with different densities. Migration reconstitutes the wave path reflections through the sedimentary layers. Subsurface surveys may also be blind to important structural events located below strong such reflectors as subsurface basalt flows.

Well surveys can offer a precise and intimate view or "look" at subsurface sediments. The physical properties of these sediments can be measured on a foot-by-foot basis. These measurements are taken from a hole that is bored through the sediments. One type of well survey is known as a dipmeter survey, which is the survey of slopes, or.the dips, of sediment beds at where they intercept the borehole. A dipmeter survey is made up of a plurality of indicators that show direction (e.g., azimuth) and inclination of a formation surface intersecting the line of the wellbore.

A survey system using the output of a dipmeter tool is disclosed in U.S. Pat. No. 4,414,656. A dipmeter tool is suspended within a wellbore and is moved through the wellbore course to produce electrical signals representative of the subsurface formations through which the wellbore penetrates. The dipmeter tool records electrical or other types of signals from directionally sensitive sensors spaced radially along the tool.

Dipmeter surveys offer a precise measurement of dip on a near continuous basis along a borehole. In general, dip varies in a continuous manner over hundreds or thousands of meters. Graphical displays of measurements taken at one-foot increments form patterns which can then be loosely classified according to their geometry. These patterns are interpreted in terms of subsurface structural configurations with a view to extrapolate the configurations at some distance from the borehole.

Extrapolating such patterns has previously been done in a qualitative, "hand-waving" manner. This hand-waving manner describes a technique for the approximate interpretation of the subterranean surfaces. Additional constraints are required to extrapolate on a sound qualitative basis. An accepted constraint is the conservation of bed thickness, which accounts for the conservation of bed volume. Another difficulty in the interpretation of dip patterns is the irregular course of the borehole through the formations. Though most boreholes in the past had a substantially vertical orientation, in recent years, directional drilling has become more commonplace. Directional drilling can achieve boreholes with a high angle of deviation from the vertical axis, and even horizontal drilling is not uncommon. Prior dipmeter techniques do not account for such borehole deviations in the interpretation of borehole patterns.

The following patents describe methods of processing and interpreting dipmeter surveys. Of the following patents, U.S. Pat. Nos. 4,873,636; 4,852,005; 4,357,660; 4,348,748; 4,303,975 were all issued to the instant inventor. U.S. Pat. Nos. 4,873,636; 4,852,005; and 4,414,656 are hereby incorporated by reference into the instant application.

U.S. Pat. No. 4,942,528 issued to Mark G. Kerzner on Jul. 17, 1990, describes a method for processing a dipmeter curve using a segmentation tree to represent the curve. The segmentation tree is converted into an event tree by deleting curve events falling outside certain event criteria. Correlation coefficients are determined and optimized between pairs of curves using the event tree, and formation dip is determined from optimized correlation curves.

U.S. Pat. No. 4,939,649 issued to John A. Duffy et al. on Jul. 3, 1990, describes a method of correcting nonunimodiality of dipmeter traces. Dipmeter data comprises nonunimodial datasets which are transformed into nonunimodial-symmetric datasets, while the subsets that are already nonunimodial-symmetric are maintained.

U.S. Pat. No. 4,873,636 issued to the instant inventor, Vincent R. Hepp on Oct. 10, 1989, describes a method of interpreting conical structures from dipmeter surveys. The dip modeling disclosed is restricted to vertical holes drilled in conical structures.

U.S. Pat. No. 4,853,855 issued to Mark G. Kerzner on Aug. 1, 1989, describes a method for processing a dipmeter curve where line segments are drawn between curve minima to create a segmentation tree. The segmentation tree is reorganized to form an event tree which is easily converted into a stored digital value and processed for correlation with other curves.

U.S. Pat. No. 4,852,005 issued to Vincent R. Hepp et al. on Jul. 25, 1989, describes a method of computing formation dip and azimuth wherein portions of at least three dipmeter surveys are matched to derive a plurality of possible offsets for defining a plurality of dips.

U.S. Pat. No. 4,414,656 issued to Vincent R. Hepp on Nov. 8, 1983, describes a well logging system for mapping structural and sedimentary dips of underground earth formations. The dips are identified by the depth at which it occurs, its dip magnitude angle, its dip azimuth angle, and the cell in a hemispherical equal area map to which the dip belongs.

U.S. Pat. No. 4,357,660 issued to Vincent R. Hepp on Nov. 2, 1982, describes a formation dip and azimuth processing technique in which dip and azimuth variations over a given interval are used to define a family of surfaces in a three dimensional reference system.

U.S. Pat. No. 4,348,748 issued to Christian M. J. Clavier et al. on Sep. 7, 1982, describes a dipmeter displacement processing technique that allows a processor to derive the most probable value of formation dip from a set of curve displacements derived from a dipmeter survey.

U.S. Pat. No. 4,303,975 issued to Vincent R. Hepp on Dec. 1, 1981, describes a dipmeter displacement qualifying technique.

While these and other references disclose methods of modeling based on dipmeter surveys, the known prior art does not disclose or suggest a method using dip modeling for all structures of constant or near constant bed thickness, and to any borehole course. For example, none described a method for accounting for borehole deviation in the interpretation of dip patterns. There currently exists a need for a precise description of subsurface geological structures based on a continuous survey of formation dip through vertical or deviated borehole. None of the above references, either alone or in combination with one another, is seen to describe the instant invention as claimed.

SUMMARY OF THE INVENTION

An advantage of the invention is to overcome the foregoing difficulties and shortcomings involved in the processing and modeling of folded subsurface geological formations based on dipmeter surveys.

Another advantage of the invention is to provide a precise description of subsurface geological structures based on a continuous survey of formation dip.

A further advantage of the invention is to map out thickness increases in hyperboloidal and sinusoidal folds of geological formations.

Yet another advantage of the invention is to account for boreholes that deviate from vertical when interpreting dip patterns.

A further advantage of the invention is to provide criteria for choosing the closest fitting mathematical solution possible to the slope measurements within the constraint of constant or nearly constant bed thickness.

To achieve these and other advantages of the invention and in accordance with the purpose of the invention, as embodied and broadly described herein, a preferred embodiment of the invention comprises the steps of (a) obtaining estimates of geometric parameters describing the geological structure as a stack of surfaces represented in an arbitrary three dimensional reference by a parametric function together with a continuous description of the borehole course within the three dimensional reference; (b) generating theoretical dip profiles from the estimates along a given borehole course within a plurality of possible mathematical solutions fitting the geological structure; (c) generating critical numbers to allow the selection of a solution model within the plurality of possible solutions; and (d) adjusting the value of the estimates iteratively to obtain a final dip profile having the highest correlation to a continuous dip sequence actually recorded from the existing dipmeter survey. A preferred embodiment of the present invention of dipmeter processing may be used with vertical as well as non-vertical or deviated boreholes. In determining the dip profile, a thickness conserving mathematical model may be fitted to a folded or faulted subsurface geological structure.

These and other advantages of the present invention will become readily apparent upon further review of the following specification and drawings.

BRIEF DESCRIPTION OF THE DRAWINGS

FIG. 2 is a table of values computed in accordance with the present invention as shown in FIG. 1.

DETAILED DESCRIPTION OF THE PREFERRED EMBODIMENTS

The only perfect thickness preserving structure that can be created by folding an originally flat stack of sheets, such as sheets of sedimentary layers, is a structure that may be represented by a stack of cones maintained at some arbitrary distance from each other. The space measured between any two cones displaced by an arbitrary axial shift is the same all around the cone, except at the apex where the space is greater. Because of the numerous agents contending in the folding of sedimentary rocks, their comparative rigidity or plasticity, their densities and relative weights, a perfectly conical fold will seldom be realized in nature. However, other forms approaching cones may be found, in particular hyperboloidal folds asymptotic to ideal cones and sinusoidal or wavy surfaces. In a perfectly conical structure, thickness is exactly preserved all over the conical surface, except at the apex where it increases abruptly. In hyperboloidal and sinusoidal folds, thickness increases about points of greatest curvature, but in a gradual manner. Such increases in thickness are accompanied by increases in rock porosities, either intergranularly in "soft" rocks, or through fractures in consolidated rocks. In addition, any well borehole drilled through a hyperboloidal or sinusoidal structure will encounter at least one member surface at any one point.

Referring now to the accompanying drawings, a preferred embodiment of the present invention is illustrated, which is exemplary in nature and should not be construed as limiting the scope of the present invention. The illustrated embodiment shows a preferred application of the present invention to fit a mathematical model solution to the slope measurements within the constraint of constant or near constant bed thickness describing subsurface geologic structures.

Figure 1:
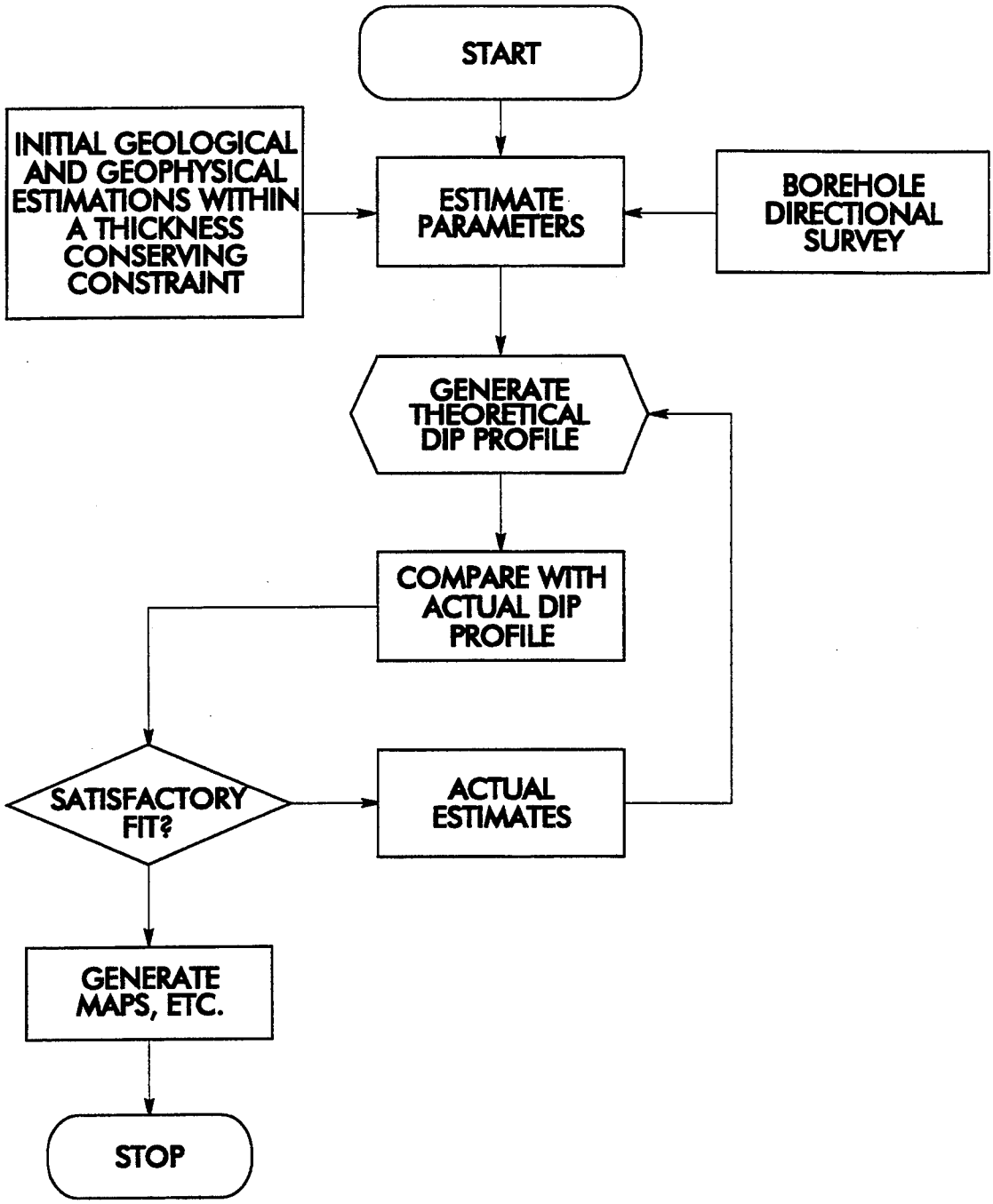
FIG. 1 is a flow chart describing the steps for the dipmeter processing technique in accordance with the present invention.

FIG. 1 shows a flow chart for outlining the method of the present invention. One skilled in the art may implement the method of the present invention using a suitable digital computer. Based on the knowledge of the distribution of bed slopes along a given borehole, the geometry of a subsurface geological structure may be described exactly by an iterative method, whether the structure is bedded and folded and/or faulted. The iterative method first estimates the geometric parameters of the geological structure within a thickness conserving constraint in accordance with a borehole directional survey. A theoretical profile of bed slopes along the borehole course is then computed using these geometric parameters. A computer with a 486 processor chip is suitable for performing these computational functions. The theoretical profile is compared to an actually measured profile, such as a processed dipmeter survey. If a satisfactory fit is not achieved between the two dip profiles, the initial parameter estimates are readjusted. A new dip profile is then recomputed and again compared to the actual dip profile. The process is reiterated until an acceptable or satisfactory fit is obtained. Statistical analysis may be employed to determine whether a satisfactory fit is achieved. At that point, the geometric parameters are deemed to model the structure accurately. In fitting the mathematical model, the borehole deviation will be taken into account for the solution. Maps of the model can be drawn and volumes can be accurately measured or computed. Dip profiles of other boreholes can then be computed and compared with actual profiles, offering further control and prompting model changes to fit unforeseen structural anomalies.

The general mathematical scheme may be described as $$F(x,y,z,\lambda)=0$$

to represent a family of surfaces in three dimensional space Oxyz, where each member of the family corresponds to a value of the monotonic function $\lambda$. Each point (x,y,z) of a borehole may be represented by values in that three-dimensional space. If one assumes that the bed boundaries constitute a family of surfaces $F(x,y,z,X)=0$, the dip at any point (x,y,z) is a vector composed of the first derivatives of F along the x, y and z directions. A theoretical dip profile may be derived given the function F and the course of the borehole. The parameter $\lambda$ can denote the depth along the well or a related measure.

The gradient of function F, composed of the three partial derivatives of F with respect to x, y and z, is a vector function of parameter $\lambda$. The gradient is orthogonal to the surface $\lambda$ at point (x,y,z) and thereby carries the unit dip vector normal to the bedding plane. Knowledge of the dip vector is equivalent to having full knowledge of the slope in both angular magnitude and direction. The gradient magnitude is a real scalar number related to the thickness separating two neighboring surfaces of the family, and thereby the compression or expansion of the geological bed comprised between those two surfaces. Consequently, to achieve a fit to real folded sediments, the gradient magnitude must be positive and vary slowly over the surface, representing the constraint of constant or nearly constant bed thickness. Even within the constraint of constant or nearly constant bed thickness, there may be multiple mathematical solutions to a set of slope measurements, and selection criteria should be utilized for guiding the choice of possible solutions. These selection criteria may be used to generate critical numbers to aid in the determination of a satisfactory fit in the selection of a solution model.

Function F may be of any form over any domain where the slow variation of its gradient is observed. Initially, polynomials of the second degree representing hyperboloidal will be chosen. In general, such polynomials afford two possible solutions, one of which must be chosen to fit the geological configuration according to a preselected criterion. For instance, one solution may describe a "synclinal" condition, while the other describes an "anticlinal" condition, both conditions being well known in the art. The synclinal condition is one with a concave upward solution, and the anticlinal condition is one with a convex upward solution. The anticlinal condition is often desirable in the petroleum industry because such a configuration has the capability of trapping hydrocarbons.

Surveyors will generally have sufficient prior knowledge of the geological configuration based on their initial surveys to reject the inappropriate solution and retain the proper fitting solution. Though selecting the proper fitting solution based on second degree functions is relatively straightforward, critical numbers may need to be generated from preselected criterion to help determine a satisfactory fit in choosing the proper solution for models with more complex functions, such as those with higher degree polynomials or irrational numbers.

In a further stage, polynomials of the third degree may be fitted, offering the possibility of "cusps," such as those configurations found in overthrust folds. Such polynomials can afford more than two possible solutions, and more elaborate criteria will be needed to choose the proper solution according to the geological configuration. Critical numbers may be generated from these criteria to help determine a satisfactory fit in selecting the proper solution. In another stage, exponential functions will be fitted. For example, wavy surfaces will be generated by circular functions. These exponential functions should cover all possible folded configurations.

Figure 3:
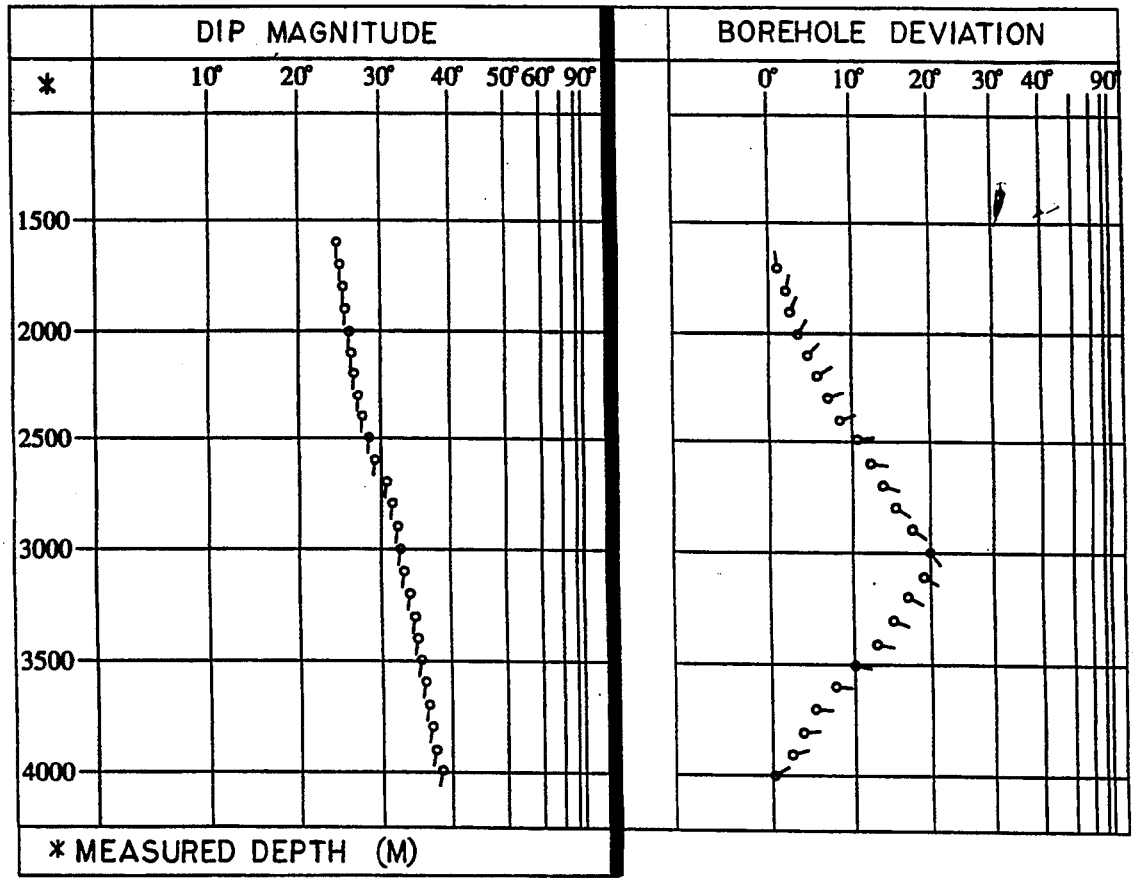
FIG. 3 shows arrow plots describing the dip magnitude and the dip deviation against the depth of the borehole.

In FIGS. 2 and 3, an examkple of maps of the dip profile according to the mathematical model of the present invention are illustrated. The data used to arrive at the numbers shown in FIG. 2 was derived from a dipmeter survey of a hyperboloidal structure of revolution. The apex of the structure was 4000 meters below sea-level, and at 2000 meters north and 650 meters west of a surface reference point. The apex was penetrated by the well head for the wellbore at 555 meters north and 632 meters west of the surface reference point, and 345 meters below sea level. Fitted functions of the present method were used to derive this data. One manner of defining the dip of the plane of a geologic structure intersecting a borehole is by two characteristics of the a unit vector normal to that plane: the dip magnitude and the dip azimuth. The dip magnitude is the angle between the vertical and that unit vector; and the dip azimuth is the angle in the horizontal plane measured clockwise between true north and the projection of that unit vector on the horizontal plane.

Sample coordinates and measurements for stacked hyperboloids of revolution penetrated by a deviated borehole are set forth in FIG. 2. The initial hypothetical values of the well location and coordinates are listed above the table. The well coordinates are calculated by a true radius of curvature method. In the table, the values of total vertical depth (TVD), x and y define the three dimensional space, where x defines the North coordinate and y defines the East coordinate. TVD is the equivalent of z in parametric function F. Parameter $\lambda$ is determined according to the mathematical model for the three dimensional space at each measured depth. Each point (x,y,TVD) of the borehole has a value in the three-dimensional space. These values can be used in the fitted mathematical model based on the dipmeter survey, where the fitted model accounts for the borehole deviation.

The resulting dip profile of the dip magnitude and corresponding borehole deviation are graphically displayed in the arrow plots as shown in FIG. 3. The dips are shown on these plots as "tadpoles" which are small circles with lines or tails emanating therefrom. In the first table, the borehole deviation measured values are displayed. Here the position of the small circles on the arrow plot shows the measured depth at which the dip occurs in the borehole against the dip magnitude. The direction of the tail shows the dip azimuth. In the second table, the small circles show the measured depth against the borehole deviation, and the direction of the tail shows the direction of the borehole with respect to true north.

Subsurface geological structures may be faulted at arbitrary locations. Faults are individual accidents, which are by nature unpredictable. Faults must be incorporated into the model at hypothetical locations. Suspect fault locations may be determined from an analysis of surface studies. Various factors to be considered in determining these hypothetical locations are the dip of the fault plane; its intercept with the borehole, if any; and the fault "throw," both in extent and in direction, as "normal" for gravity slippage, "reverse" for upward slippage, "thrust" for horizontal overriding, and "strike" or "transcurrent" for horizontal slippage along the strike of the fault. The throw is the amount one block of fault has been displaced. Calculation of the model is initiated in an arbitrarily selected half space relative to the fault, and is continued beyond the fault in its other half space by the simple addition of the translation vector described by the throw. The vector may or may not be constant along the face of the fault.

It is to be understood that the present invention is not limited to the exemplary embodiments described above. It will be apparent to those skilled in the art that various modifications and variations are possible within the spirit and scope of the present invention. The present invention encompasses any and all embodiments within the scope of the following claims.

I claim:

1. A method of assisting in the precise geometric description of a folded subsurface geological structure utilizing a computer and continuous dip sequence data from a dipmeter survey obtained through a wellbore penetrating the geological structure, comprising the steps of:

obtaining estimates of geometric parameters from the dipmeter survey describing the geological structure as a stack of surfaces represented in a three dimensional reference by a parametric function together with a continuous description of the borehole course within the three dimensional reference;

generating theoretical dip profiles using the estimates along a given borehole course within a plurality of possible mathematical solutions fitting the geological structure;

generating critical numbers to allow the selection of a solution model within the plurality of possible solutions; and adjusting the value of the estimates iteratively to generate and display a final dip profile having the highest correlation to the continuous dip sequence from the dipmeter survey.

2. The method according to claim 1, wherein the parametric function is a space filling, non-negative gradient three dimensional parametric function.

3. The method according to claim 1, wherein the step of obtaining estimates of geometric parameters further includes the generation of parametric critical numbers to assist in the selection of the three dimensional parametric function.

4. The method according to claim 1, wherein the borehole course is a deviated borehole.

5. The method according to claim 1, wherein the geometric structure includes a plurality of faults describable within the three dimensional reference.

6. The method according to claim 1, wherein a gradient magnitude is continuously displayed over the stack of surfaces to identify zones of probable decompression associated with increased porosity.

7. The method according to claim 1, wherein graphical displays are derived from the solution model.

8. The method according to claim 1, wherein the estimates are obtained within a thickness conserving constraint.

9. The method according to claim 1, wherein the parametric function is a space filling, non-negative gradient three dimensional parametric function defining stacked cones of revolution.

10. The method according to claim 1, wherein the geometric parameters are selected from the group consisting of axial plane location and dip, ellipticity, minimum radius of curvature, plunge and aperture.

11. The method according to claim 1, wherein the borehole course is a vertical borehole.

12. The method according to claim 1, wherein the borehole course is a horizontal borehole.

* * * * *